United States Patent [19]

Henes et al.

[11] Patent Number: 4,545,603

[45] Date of Patent: Oct. 8, 1985

[54] RING BINDING WITH BROADENED RINGS

[75] Inventors: Martin E. Henes, Denville; George Roth, New Milford, both of N.J.

[73] Assignee: Spiral Binding Company, Inc., Clifton, N.J.

[21] Appl. No.: 569,036

[22] Filed: Jan. 9, 1984

[51] Int. Cl.[4] ..... B42B 5/10

[52] U.S. Cl. ..... 281/21 A; 402/19

[58] Field of Search ..... 281/21 R, 21 A, 25 R, 281/25 A; 402/19

[56] References Cited

U.S. PATENT DOCUMENTS

| | | | |
|---|---|---|---|
| 2,141,581 | 1/1939 | Trussell | 281/25 A |
| 2,185,004 | 12/1939 | Trussell | 281/25 A |
| 2,583,998 | 1/1952 | Cook | 251/25 R X |

*Primary Examiner*—Paul A. Bell

*Attorney, Agent, or Firm*—Charles E. Baxley

[57] ABSTRACT

A wire ring binder is formed of a continuous segment of wire bent in an undulating form in which finger sections extend in a parallel array from a colinear array of backbone sections. The width of the fingers approximates the length of elongated apertures in sheet material which is to be bound. In the case wherein the spacing between apertures is equal to the aperture length for maximum strength and ease of perforation, the width of the fingers is slightly less than the spacing between fingers to provide clearance in the apertures. Each finger is formed of two sections of wire joined together by an arcuate terminating section which overlaps into the spacing between backbone sections.

3 Claims, 8 Drawing Figures

RING BINDING WITH BROADENED RINGS

BACKGROUND OF THE INVENTION

This invention relates to bindings for books, notebooks and other configurations of stacks of paper or other sheet material and, more particularly, to a metallic ring binder formed of a continuous wire. A binding formed of a continuous segment of metallic wire is commonly used in the binding of stacks of sheet material such as paper to form books, particularly notebooks. One form of binding is constructed by bending the wire in the shape of a spiral, and then passing turns of the spiral through free formed apertures in the sheet material. Such a binding is known as a spiral binding and has been in use for many years. A characteristic of the spiral binding is the employment of a single aperture for each turn of the spiral, with the apertures being spaced apart between centers by a distance equal to the spacing between turns of the spiral. The apertures are made sufficiently small to allow for an adequate amount of sheet material therebetween to inhibit tearing of the sheet material by the wire.

The spiral binding has been found to provide adequate strength for holding together the sheet material, particularly paper bound into notebooks. However, the spiral binding suffers a disadvantage in that a cumbersome process is required for assembly of the binding, the processing requiring the rotation of the spiral for threading the end of the spiral into successive ones of the apertures.

The foregoing disadvantage is avoided in a ring formed of wire binding wherein the wire is bent back and forth to provide a succession of tabs or fingers extending from a set of colinear sections of wire. The set of colinear sections of wire may be referred to as the backbone of the binding. Prior to insertion of the wire into the apertures of the sheet material, the bent wire has the configuration of a comb, rather than a spiral. Each finger is composed of two sections of wire bent back upon each other. The fingers of the comb are then curved to pass through the apertures and form rings which terminate on the backbone. The rings hold the sheet material together.

The ring binding is used as a substitute for the spiral binding. Machinery exists for the simultaneous bending of all of the fingers for simultaneous formation and insertion of the rings into all of the apertures of the sheet material. By way of example in the construction of such a ring binding, U.S. Pat. No. 4,373,558 in the name of K. H. Dawson (at FIG. 1) shows the comb-like form of the bent wire and a machine for bending the wire. In the construction of the ring binding, it has long been the practice to conform the shape of the binding as closely as practicable to the shape of the spiral binding. Thereby the two bindings may be used interchangeably without loss of strength and utility.

The conforming of the shape of the ring binding to the shape of the spiral binding has been accomplished by making each finger as narrow as practicable whereby the double turns of wire in each turn of the binding approximate the single pass of wire in a turn of the spiral. The spacing between turns of the ring binding approximates the spacing between turns of the spiral binding. This spacing is substantially larger than the width of the finger of the ring binding. In the ring binding, the apertures are somewhat larger than those of the spiral binding to accommodate the double wire of each turn of the ring binding.

Yet another form of binding is constructed of plastic sheet stamped in the shape of a comb wherein the width of the fingers is approximately equal to the spacings between edges of the fingers. The comb is set with a permanent curvature to provide a set of rings which pass through elongated rectangular apertures in the sheet material which is to be bound. This plastic binding is widely used today, primarily because of the facile manner in which it can be inserted in the apertures. Such insertion is accomplished with the aid of machinery which spreads the rings apart for threading the fingers into the apertures, and thereafter the machine allows the rings to close to complete the binding. A problem arises in that the plastic binding lacks much of the strength present in the metallic wire binding. This is particularly true in the event that the plastic ages, in which case the plastic may crack. While the aforementioned metallic ring binding may be employed to provide the additional strength, the ring spacing and width does not fit the elongated rectangular apertures of the plastic ring bindings. This is a significant inconvenience since the perforation equipment for producing the elongated apertures is widely used and readily available.

SUMMARY OF THE INVENTION

The foregoing problem is overcome and other advantages are provided by a wire ring binder for binding sheet material. In accordance with the invention, the rings of the binder are widened to a width comparable to the spacing between edges of the rings. It is thus an object of the invention to provide a wire ring binder configured for insertion within elongated rectangular apertures, so as to be interchangeable with the plastic ring binders.

Further, in accordance with the invention, the rings are formed as fingers of a comb by bending a wire in a sequence of undulations. Each finger comprises two wires joined at the terminus of the finger by a wire segment parallel to the backbone of the comb. The segments of the backbone are approximately equal in length to the terminating segments of the fingers.

BRIEF DESCRIPTION OF THE DRAWING

The foregoing aspects and other features of the invention are explained in the following description taken in connection with the accompanying drawing wherein.

DETAILED DESCRIPTION

Figure 1:
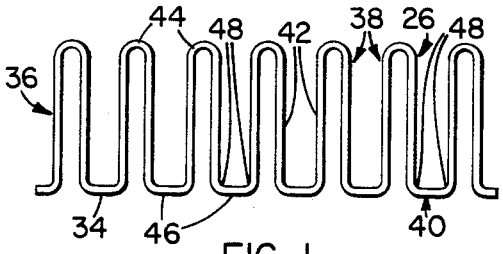
FIG. 1 is a plan view of a wire segment bent into a planar undulating form for producing a ring binder.

With reference to the figures, there is shown a stack 20 (FIG. 8) of sheet material, such as a stack of pages of paper, which is bound together with a binding 22 to form a notebook 24.

In accordance with the invention, the binding 22 comprises a wire ring binder 26 (FIG. 3) having rings 28 positioned within elongated apertures of the pages of the stack 20. One exemplary page 30 of the stack 20 is partially shown in FIG. 7 and includes a series of elongated apertures 32 arranged in a line array along the edge of the page 30 which is to be secured in the binding 22.

Figure 2:
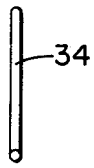
FIG. 2 is an end view of the wire form of FIG. 1.
Figure 4:
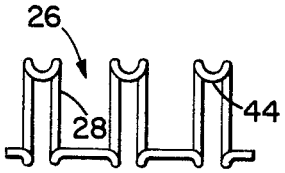
FIGS. 4 and 5 show, respectively, a side elevation view and an end view of the binder of FIG. 2, with the fingers shown partially bent preparatory to insertion in sheet material.
Figure 5:
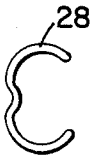
Figure 8:
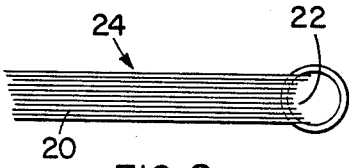
FIG. 8 shows an end view of a notebook bound by the binder of FIG. 3.

Construction of the preferred embodiment of the binder 26 proceeds by bending a wire 34, preferably a carbon steel wire, such as carbon steel C 1008 finished with a bright tin coating, into a planar undulating form resembling a comb 36 as shown in FIGS. 1 and 2. The comb 36 comprises fingers 38 extending laterally from a backbone 40. Each finger 38 includes a pair of finger sections 42 of the wire 34, the finger sections of each finger 38 being joined at their outer ends by an arcuate terminating section 44 of the wire 34. The backbone 40 comprises a series of backbone sections 46 of the wire 34, the backbone sections 46 being spaced apart and being located between the fingers 38. Each pair of adjacent fingers 38 is joined by a backbone section 46. Connection between a backbone section 46 and a finger section 42 is made at a junction 48 which is curved to permit overlapping of a terminating section 44 between two backbone sections 46 (FIG. 6) upon enclosure of the binder 26. As shown in FIG. 1, the locations of the terminating sections 44 alternate with the locations of the backbone sections 46 along the wire comb 36, thereby to provide for the foregoing overlap. Construction of the binder then proceeds with the bending of the fingers 38 to form the rings 28. To affix the binder 26 to the stack 20, the fingers 38 are partially bent to form open rings 28 (FIGS. 4 and 5) whereby the ends of the fingers 38 are positioned for threading into the apertures 32 of the pages 30 in the stack 20. After insertion of the fingers 38 into the apertures 32, the rings 28 are then closed (FIGS. 3 and 6) to complete the binding 22 for forming the notebook 24 (FIG. 8). The bending of the fingers 38 and the subsequent closure of the rings 28 are accomplished with conventional bending apparatus.

Figure 7:
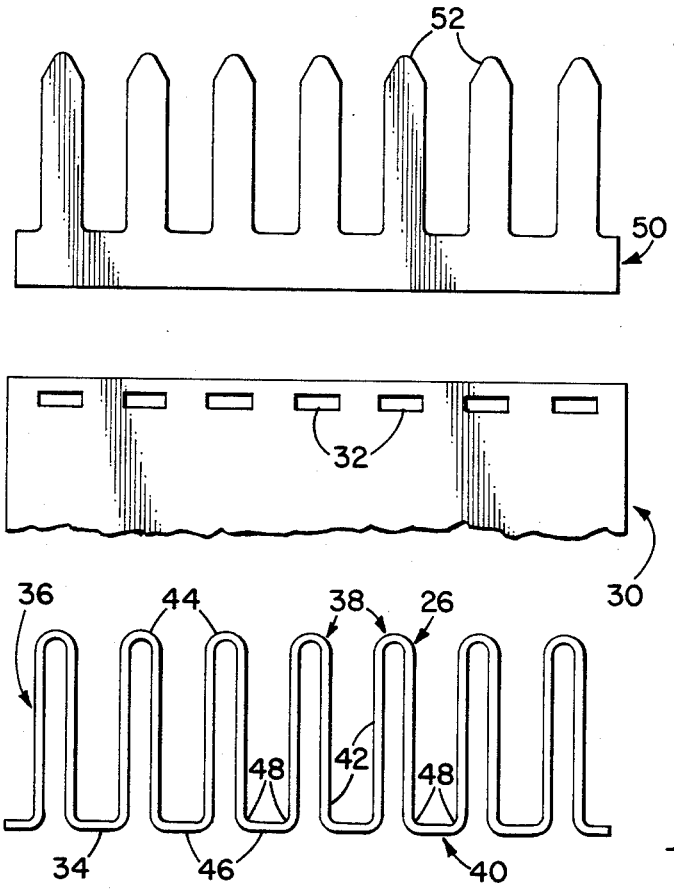
FIG. 7 PRIOR ART
FIG. 7 shows the relationship between a plastic binding element of the prior art, the wire binder of the invention, and a sheet of paper having elongated apertures for receiving either of the two binders.

The relationship between the binder 26, the page 30, and a plastic binding element 50 of the prior art is shown in FIG. 7. The binder 26, the page 30, and the binding element 50 are arranged one above the other so as to show the equality of spacing among the fingers 38 of the binder 26, the apertures 32 of the page 30 and the fingers 52 of the binding element 50. The widths of the fingers 38 and 52 are equal for insertion within the apertures 32, the widths of the fingers 38 and 52 being somewhat less than the lengths of the apertures 32 but sufficiently large so as to allow for negligible clearance. Assuming approximate equality between the lengths of the apertures 32 and the spacings therebetween, the widths of the fingers 38 are slightly less than the lengths of the backbone sections 46. Thus, in the binder 26, the rings 28 have widths approximately equal to the spacing therebetween, and also the length of a backbone section 46 is approximately equal to the length of a termination section 44 as measured along the axis of the binder 26.

It is noted that, in accordance with a feature of the invention, the finger sections 42 of any one finger 38 or ring 28 contact an aperture 32 near the ends thereof so as to attain a maximum amount of strength in the binding 22. Also, this relationship between the finger sections 42 and an aperture 32 insures that there is no more than a negligible amount of side slip of a ring 28 within its aperture 32. This insures that the finger sections 42 remain in their respective positions adjacent the ends of an aperture 32.

Figure 3:
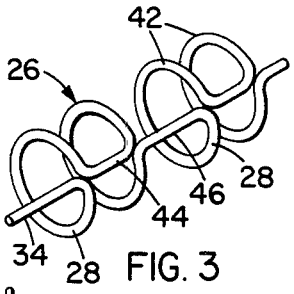
FIG. 3 is an isometric view of a binder of the invention produced by bending fingers of the wire form of FIG. 1.
Figure 6:
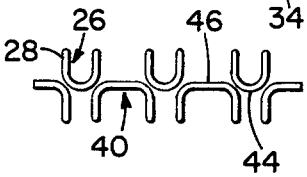
FIG. 6 is a side elevation view of the binder of FIG. 3.

With reference to FIGS. 3 and 6, the binder 26 with the closed rings 28 presents the foregoing arrangement of approximate equality in the spacing between adjacent finger sections 42. Thus the arrangement of the finger sections 42 is seen to extend from a front end of the binder 26 to a back end thereof, and wherein there is a first set of finger sections 42 extending from front ends of respective ones of the backbone sections 46. A second set of finger sections 42 extends from the back ends of respective ones of the backbone section 46. Each finger 38 or ring 28 thus comprises a section 42 of the first set and a section 42 of the second set of finger sections. The finger sections 42 are connected alternately by termination sections 44 and backbone sections 46.

In operation, the respective terminating sections 44 pass through the apertures 32 in the pages 30 of the stack 20 to meet with the front and back ends of adjacent ones of the backbone sections 46. The curvature at the junctions 48 in combination with the curvature of the terminating section 44 provides space for overlap, which overlap prevents the egress of pages 30 from the stack 20 so as to ensure that all of the pages 30 remain within the notebook 24. In addition, the overlap is accomplished within the generally cylindrical envelope of the binder 26, so as to avoid any bunching of the wire 34 which might fray the apertures 32.

In view of the enlarged spacing between the sections 42 of a ring 28, the wire 34 must be sufficiently stiff to maintain dimensional stability of the binder 26. By way of example, suitable stiffness has been obtained in the construction of an exemplary binder 26 in a preferred embodiment of the invention employing the following dimensions. The spacing between centers of the rings 28 is 9/16 inch. The diameter of the wire is 0.031 inch. The width of a finger 38 is ¼ inch, the terminating sections 44 being configured as a semicircle, thus providing a full radiused tip. The backbone radii at the junctions 48 are 1/16 inch. The outer diameter of a ring 28 is 1 inch. A typical wire specification is low carbon steel wire C1008, finished with bright tin coating.

Tensile Strength:
- 0.031—101/104,000 P.S.I.
- 0.0348—97/101,000 P.S.I.
- 0.037—93/98,000 P.S.I.
- 0.041—86/90,000 P.S.I.
- 0.047—82/86,000 P.S.I.

Analysis:
- 0.10 Max. Carbon
- 0.25/0.50 Manganese
- 0.04 Max. Phosphorus
- 0.05 Max. Sulphur Naturally the wire specification, diameters and configurations vary with specific applications.

The foregoing construction has provided a binder adapted for use with sheet material having elongated apertures so as to provide for the binding of such material. The binder can be fabricated with existing forms of machinery so as to be substituted readily for pre-existent plastic binding elements.

It is to be understood that the above described embodiment of the invention is illustrative only, and that modifications thereof may occur to those skilled in the art. Accordingly, this invention is not to be regarded as limited to the embodiment disclosed herein, but is to be limited only as defined by the appended claims.

We claim:

1. A wire ring binder for binding sheet material perforated with identical apertures which are elongated parallel to an edge of the material to an extent wherein the spacing between successive ones of the apertures is constant and approximately equal to the length of the apertures, said binder being formed of a continuous wire segment and comprising:

a backbone formed of a sequence of spaced apart aligned sections of said wire;

a first set of finger sections of said wire extending from the front ends of respective ones of said backbone sections;

a second set of finger sections of said wire extending from the back ends of respective ones of said backbone sections, the finger sections of said first set and of said second set being substantially perpendicular to their respective backbone sections, each of said finger sections of said first and said second sets being curved in a plane normal to said backbone for entry through one of said apertures;

terminating sections of said wire, each of said terminating sections connecting an outer end of a finger section of said second set on one backbone section with the end of a finger section of said first set on the next backbone section, the terminating sections being spaced from each other by spacings approximately equal to the spacings between said backbone sections and alternating in location along said binder with the location of said backbone sections;

each said terminating section and its connected finger sections forming a finger of width less than said aperture length but sufficiently large to provide negligigle clearance between said fingers and the ends of said apertures; and the junctions between said fingers and the corresponding ends of said backbone sections being curved, and said terminating sections being curved for partial overlaps with said backbone sections to form an interlock which prevents egress of sheet material from the binder.

2. A binder according to claim 1 wherein said wire is metallic spring wire.

3. A binder according to claim 2 wherein the wire is spring steel coated with tin or nylon.

* * * * *